US005526966A

United States Patent [19]

Lutzker

[11] Patent Number: 5,526,966

[45] Date of Patent: Jun. 18, 1996

[54] CONDIMENT SHAKER

[76] Inventor: Robert S. Lutzker, 10 Woodstone Ct., South Huntington, N.Y. 11746

[21] Appl. No.: 315,109

[22] Filed: Sep. 29, 1994

[51] Int. Cl.[6] ..... B65D 47/00

[52] U.S. Cl. ..... 222/480; 222/548; 222/553; 222/565

[58] Field of Search ..... 222/480, 548, 222/553, 565

[56] References Cited

U.S. PATENT DOCUMENTS

| | | | |
|---|---|---|---|
| 2,780,395 | 2/1957 | Schlabach et al. | 222/548 X |
| 2,961,133 | 11/1960 | Ankney | 222/548 |
| 2,971,681 | 2/1961 | Galbierz | 222/480 X |
| 3,292,840 | 12/1966 | Schmidt | 220/4.24 X |
| 3,463,364 | 8/1969 | Rehag | 222/548 X |
| 3,467,287 | 9/1969 | Marchant et al. | 222/548 X |
| 3,494,515 | 2/1970 | Fattori | 222/548 |
| 4,301,949 | 11/1981 | Palson et al. | 222/565 X |
| 5,356,035 | 10/1994 | Shlopak et al. | 222/548 X |
| 5,383,582 | 1/1995 | Baxter et al. | 222/548 |
| 5,407,107 | 4/1995 | Smith | 222/565 X |

FOREIGN PATENT DOCUMENTS

| | | | |
|---|---|---|---|
| 936483 | 11/1973 | Canada | 222/553 |
| 732707 | 6/1955 | United Kingdom | 222/553 |

*Primary Examiner*—Andres Kashnikow
*Assistant Examiner*—Kenneth Bomberg
*Attorney, Agent, or Firm*—Kane, Dalsimer, Sullivan, Kurucz, Levy, Eisele & Richard

[57] ABSTRACT

A salt and pepper shaker includes a pair of mating body parts joined along a vertical edge. A rotatable top is coupled with the upper part of the body members and includes an opening that is adapted to be sequentially aligned with a filling opening in one of the body members and pour holes in the other body member. Latching means aligns the top hole with either the filling opening, pour holes or intermediate sealing positions.

15 Claims, 5 Drawing Sheets

CONDIMENT SHAKER

BACKGROUND OF THE INVENTION

Salt and pepper are both found in virtually every home and every kitchen throughout the world. These days with refrigeration, salt and pepper are in widespread use for flavoring of foods. Throughout history people have searched for the perfect vessel for storage and dispensing of salt and pepper. It appears that this search has involved virtually tens of thousands of designs over these many years.

It is with the vast amount of history of spices throughout the ages in mind what the present invention seeks to do, namely, development of the perfect container for storage and dispensing of salt and pepper. The shape of a sphere, a true sphere is wholly unique, pleasing to handle and provides a number of important functions, all of which would approach the perfect container.

SUMMARY OF THE INVENTION

The principal object of the present invention is to provide a condiment shaker that is aesthetically pleasing in appearance and is made up of a minimum number of molded plastic parts that are easily assembled.

Another object is to provide a shaker of the foregoing type that is substantially spherical yet designed to always attain an upright position.

A further object is to provide a shaker of the foregoing type that includes a rotatable top that is adapted to be turned to three selected positions at which pour holes are exposed, a filling opening is exposed and the shaker is sealed.

Other objects and advantages will become apparent from the following detailed description which is to be taken in conjunction with the accompanying drawings.

DETAILED DESCRIPTION OF THE PREFERRED EMBODIMENTS

Figure 1:
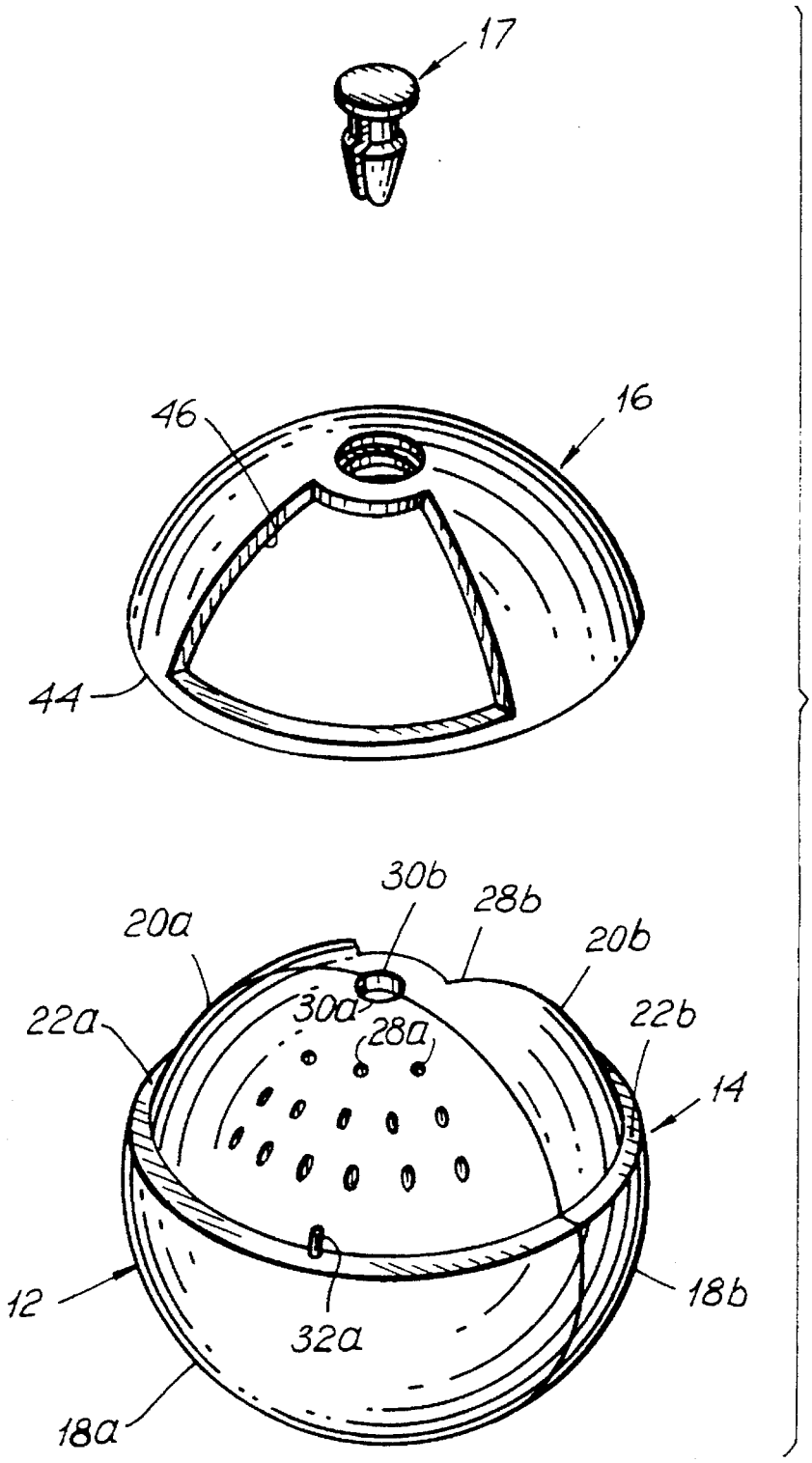
FIG. 1 is an exploded perspective view of the salt and pepper shaker of this invention.
Figure 2:
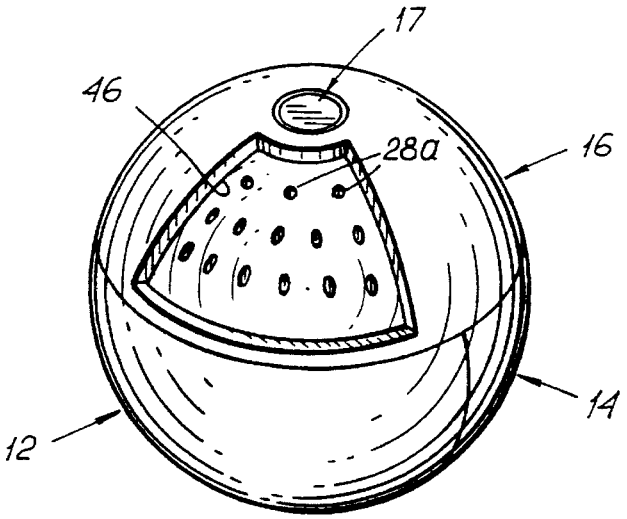
FIG. 2 is a perspective view of the assembled shaker with the rotatable top turned to expose the pouring holes.
Figure 3:
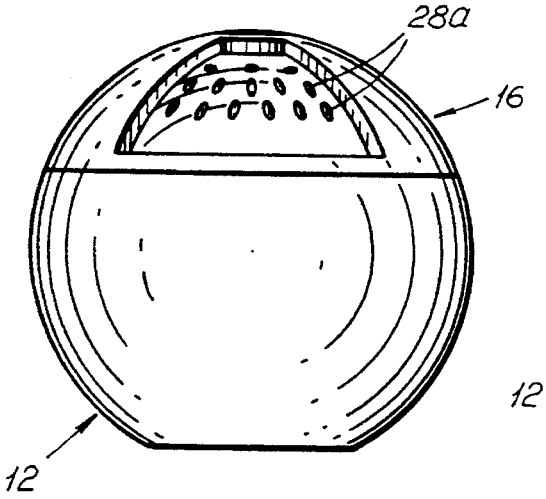
FIG. 3 is a front elevational view thereof.
Figure 4:
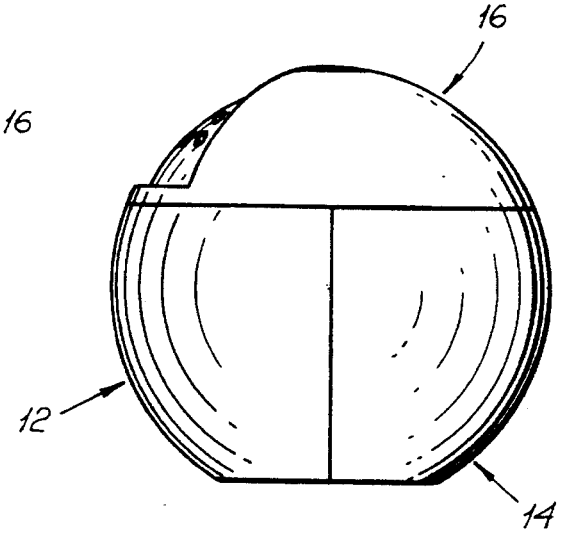
FIG. 4 is a side elevational view thereof, with the other side being a mirror image thereof.
Figure 5:
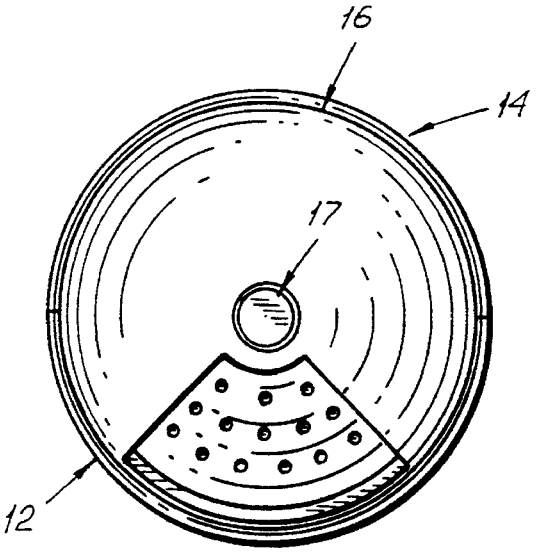
FIG. 5 is a top plan view thereof.
Figure 6:
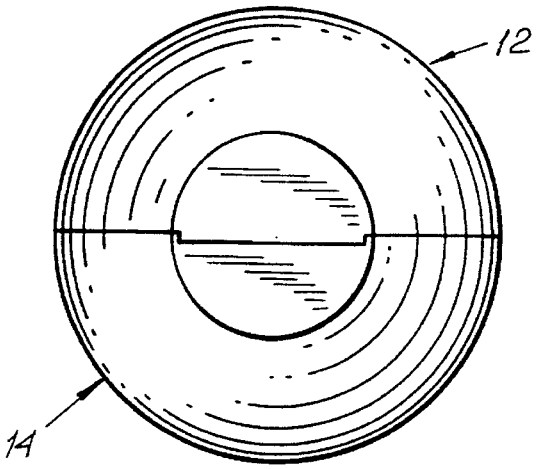
FIG. 6 is a bottom plan view thereof.
Figure 7:
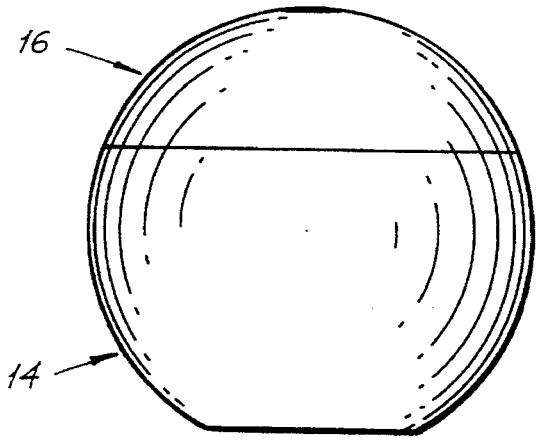
FIG. 7 is a rear elevational view thereof.
Figure 8:
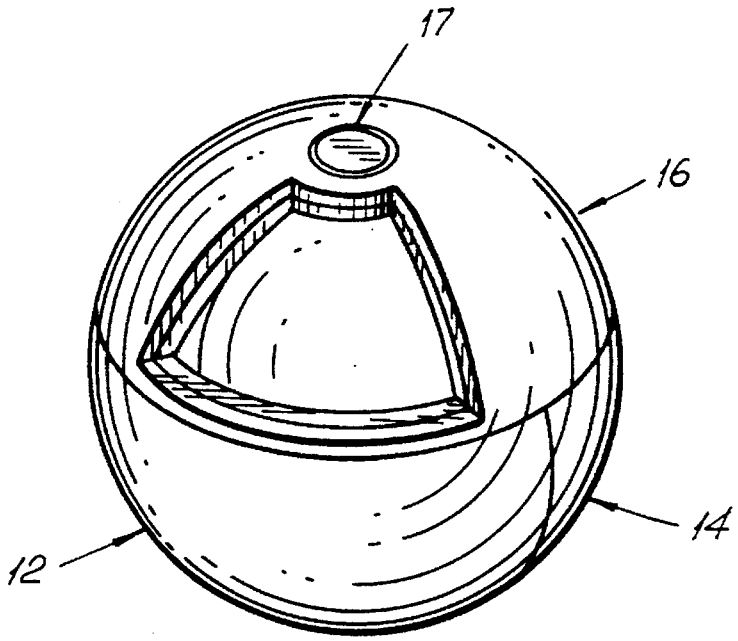
FIG. 8 is a perspective view of the shaker with the rotatable top turned to expose the fill opening.
Figure 9:
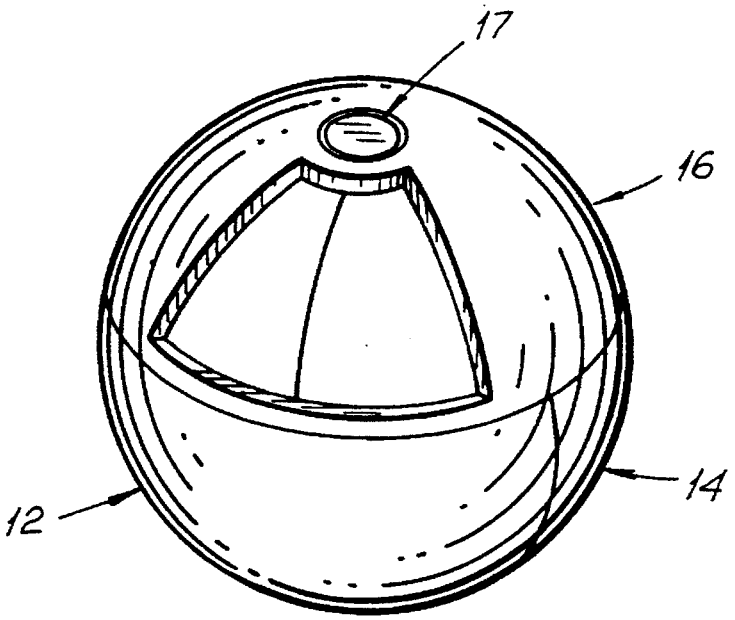
FIG. 9 is a perspective view of the shaker with the rotatable top turned to the sealed position.
Figure 10:
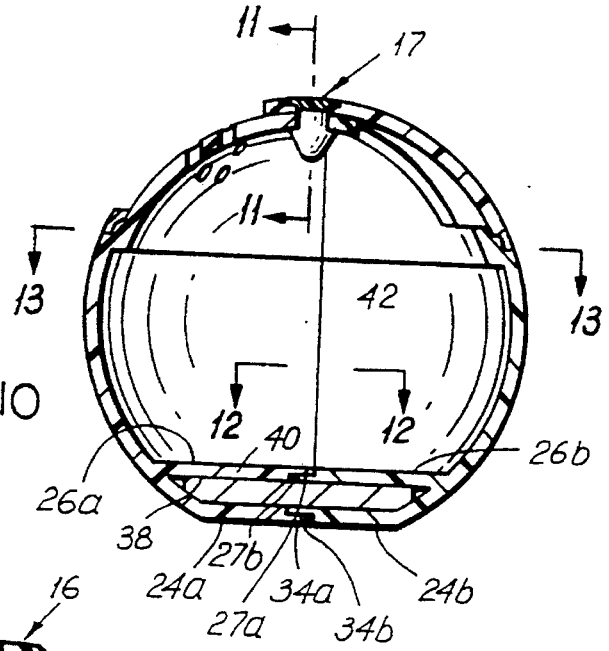
FIG. 10 is a sectional view taken along the line 10—10 of FIG. 3.
Figure 11:
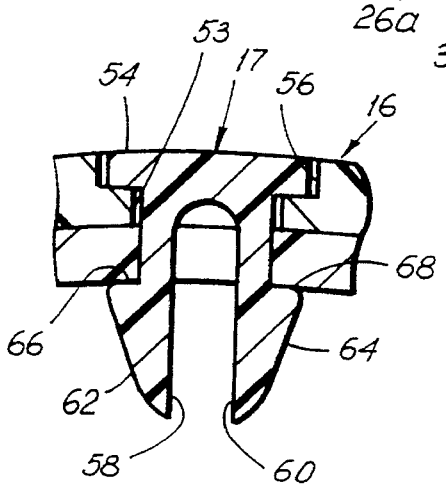
FIG. 11 is an enlarged fragmentary sectional view taken along the line 11—11 of FIG. 10.
Figure 12:
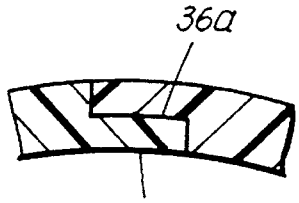
FIG. 12 is an enlarged fragmentary sectional view taken along the line 12—12 of FIG. 10.
Figure 13:
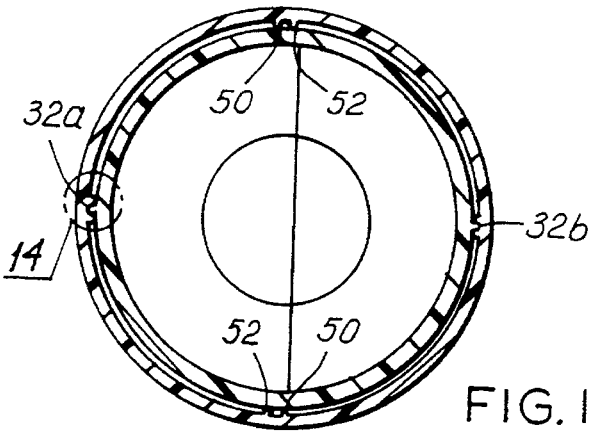
FIG. 13 is a sectional view taken along the line 13—13 of FIG. 10.
Figure 14:
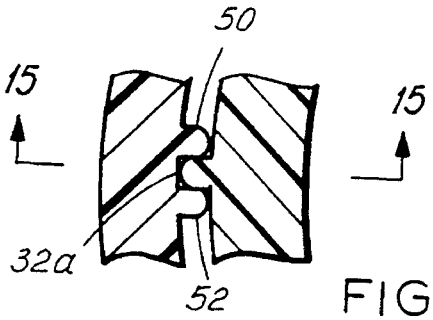
FIG. 14 is an enlarged fragmentary sectional view of the releasable latch for releasably latching the rotatable top to alternatively expose the pouring holes, fill opening or latch it in a sealed position.
Figure 15:
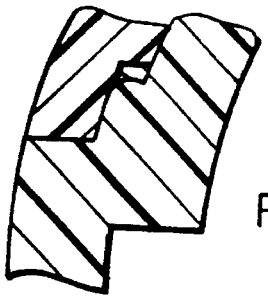
FIG. 15 is an enlarged fragmentary sectional view taken along the line 15—15 of FIG. 14.

In the drawings, a condiment and preferably salt and pepper shaker 10 of the present invention is illustrated and includes a pair of mating body halve members 12 and 14, a rotatable top 16 and a securement pin 17. All of these members may be injection molded from a suitable resin with the body members 12 and 14 and top 16 when assembled forming substantially spherical enclosure for condiments.

Body member 12 is formed with a lower part 18*a* having a first radius and an upper part 20*a* having a slightly smaller radius with a substantially horizontal shelf 22*a* intermediate both parts. A substantially flat bottom 24*a* is formed at the base of the lower part 18*a* with a horizontal shelf 26*a* with an extending tongue 27*a* being spaced slightly above the bottom 24*a*. Pour holes 28*a* arranged in a predetermined pattern are formed in upper part 20*a*. A semi circular hole 30*a* is also formed at the top of the upper part 20*a*. A lug 32*a* on the upper part 20*a* extends upwardly from the midpoint of shelf 22*a* and an tongue 34*a* extends horizontally from the flat bottom 24*a* for purposes that will be explained below. A recessed groove 36*a* is formed around the inner vertical periphery of the body member 12.

Body member 14 is also formed with a lower part 18*b* and an upper part 20*b* possessing the same radius as parts 18*a* and 20*a*, respectively, of member 12; and these parts are separated by an intermediate shelf 22*b*. A substantially flat bottom 24*b* is at the base of the lower part 18*b* together with a spaced horizontal shelf 26*b* having a groove 27*b* that receives tongue 27*a* of shelf 26*a* to substantially seal this juncture. A fill opening 28*b* is formed in upper part 20*b* and possesses a predetermined configuration similar to the peripheral outline of pouring holes 28*a*. Semi circular hole 30*b* is also formed in the upper part 20*b*. A lug 32*b* on the upper part 20*b* extends upwardly from the midpoint of shelf 22*b*. A groove 34*b* is in the flat bottom 24*b* and receives the tongue 34*a* of member 12 to prevent members 12 and 14 from rotating relative to one another. A peripherally extending vertical tongue 36*b* is received by the peripheral groove 36*a* of member 12 to seal this juncture. The mating flat bottoms 24*a*, 24*b*, and horizontal shelves 26*a*, 26*b* define a compartment 38 that accommodates a weight 40 of suitable material which may be metal that acts to maintain the shaker 10 in an upright position and return it to this position if placed on a receiving surface at any other angle. The upper compartment 42 advantageously receives the selected condiment such as salt or pepper.

The rotatable top 16 mates with upper parts 20*a*, 20*b* and possesses an inner radius slightly larger than the external radius of these parts 20*a*, 20*b* and includes a lower peripherally extending circular edge 44 that rests on shelves 22*a*, 22*b*. The exterior surface of the top 16 and body members 12, 14 possess substantially the same radius to define a substantially spherical shaker 10. An opening 46 is provided in top 16 and is of a size and configuration resembling that of filling opening 28*b*. When opening 46 is turned to be aligned with openings 28*b*, the interior compartment 42 can be filled with the selected condiment, or, where desired, larger amounts of this condiment may be dispensed through these openings. When rotated to be aligned with pour holes 28*a*, the condiment in compartment 42 may be disposed when top opening 46 is intermediate fill opening 28*b* and pour holes 28*a*. The interior of the shaker and, specifically, the compartment 42 is effectively sealed. The lower interior surface 48 at the lower edge 44 is slightly recessed and includes four pairs of spaced lugs 50, 52 that receive lugs 32*a*, 32*b* in centering top opening 46 and aligning it with either pour holes 28*a*, filling opening 28*b* or either of the sealed positions therebetween. The top is also provided with a central opening 53 adapted to be aligned with openings 30*a*, 30*b*.

In order to maintain the member 12 and 14 and top 16 in an assembled condition, securement pin 17 advantageously is received by and is anchored in opening 30*a*, 30*b*. In this regard, the pin 17 includes a head 54 that rests in recess 56 in the top 16. A pair of spring arms 58 and 60 extend downwardly from head 54 and include lower downwardly beveled faces 62, 64, respectively that define the respective shoulders 66, 68. Beveled faces 62, 64 facilitate insertion of the pin 17 into holes 53, 30*a*, 30*b* forcing the arm 58, 60 to flex inwardly. When the shoulders clear holes 30*a*, 30*b*, the arms spring outwardly to cause the shoulder to engage with the interior surfaces of the members 12, 14, to anchor the pin 17 in hole 30*a*, 30*b* and, consequently, maintain the members 12, 14 and top 16 in an assembled condition.

It should be understood that the present invention contemplates joining members 12 and 14 along a horizontal or any other orientation of seam or edge to provide the spherical configuration of the shaker body.

Thus, with the rotation of the top a window is provided for pouring, a window for filling and volume usage in the kitchen as well as providing a position of rotation which seals the salt or pepper to help prevent moisture from entering; as well as facilitates carrying for picnics, barbecues, etc. The weighted bottom provides another novel aspect which is that regardless of how this ball is placed down it will always find the center of gravity and go to an upright position. This combines novelty with form and function for what is believed to be the perfect embodiment of a uniquely functional and clean product combining so many heretofore unaddressed features in the search for perfection.

Thus, the several aforenoted objects and advantages are most effectively attained. Although a single somewhat preferred embodiment has been disclosed and described in detail herein, it should be understood that this invention is in no sense limited thereby and its scope is to be determined by that of the appended claims.

I claim:

1. A condiment shaker for a selected condiment comprising a pair of upwardly extending mating hemispherically shaped body members having vertical and circumferentially extending mating edges and defining an interior compartment for the selected condiment, each of the body members being so constructed and arranged to define an upper part and lower part, a rotatable top extending over the upper part, means for providing access to and from the compartment for the selected condiment through the top and body upper part of the members, and coupling means coupled with the top and body members for connecting the top and body members in an assembled condition to form a substantially spherical enclosure for the selected condiment.

2. The invention in accordance with claim 1 wherein the upper part of one member includes pour holes and the upper part of the other member includes a filling opening, an opening in the top adapted to be rotated and aligned with the filling opening to fill the compartment with the selected condiment and the pour holes to dispense the selected condiment.

3. The invention in accordance with claim 2 wherein the pour holes are about the same size and configuration as one another.

4. The invention in accordance with claim 2 wherein the opening in the top is adapted to be rotated to a sealed position intermediate the pour holes and opening in the body member to effectively seal the compartment.

5. The invention in accordance with claim 4 wherein interengaging latching surfaces of the top and body members releasably align and latch the top opening with the pour holes and fill opening in the body members and the sealed position.

6. The invention in accordance with claim 1 wherein the body members have a base and a flat bottom located at the base.

7. The invention in accordance with claim 1 wherein the body members and top define a substantially spherical configuration.

8. The invention in accordance with claim 7 wherein means are provided for preventing the body members from rotating relative to one another.

9. The invention in accordance with claim 1 wherein the mating edges of the body members include a peripherally extending tongue and groove connection to seal this juncture.

10. The invention in accordance with claim 1 wherein the upper part of the body members are recessed and receive the top, the top and the lower part of the body members have an exterior surface each possessing substantially the same radius to define a substantially spherical shaker.

11. The invention in accordance with claim 1 wherein the top and body members are molded and formed from plastic.

12. A condiment shaker for a selected condiment comprising a pair of mating body members having mating edges and defining an interior compartment for the selected condiment, body members being so constructed and arranged to define an upper part and lower part, a rotatable top extending over the upper part, means for providing access to and from the compartment for the selected condiment through the top and body upper part of the members, and means for connecting the top and body members in an assembled condition the body members having a base and a shelf spaced from the base to define a lower compartment, and a weight in the lower compartment to maintain the shaker in an upright condition.

13. The invention in accordance with claim 12 wherein the shelf of the body members include a tongue and groove connection to seal this juncture.

14. A condiment shaker for a selected condiment comprising a pair of mating body members having mating edges and defining an interior compartment for the selected condiment, body members being so constructed and arranged to define an upper part and lower part, a rotatable top extending over the upper part, means for providing access to and from the compartment for the selected condiment through the top and body upper part of the members, and means for connecting the top and body members in an assembled condition the upper part of the body members having interior surfaces, the connecting means including a securement pin, aligned holes defined by hole surfaces in the top and upper part of the body members receiving the pin, the pin having a head engaged with the top and a pair of spring arms extending from the head and having free ends, the free ends of the arms having a beveled surface that defines an intermediate shoulder that engages with the interior surfaces of the upper part of the body members, the spring arms are adapted to flex inwardly upon engagement of the beveled surfaces with the hole surfaces defining the aligned holes in the top and the upper part of the body members until the shoulder clears the aligned holes in the top and upper part of the body member and the arms spring outwardly to engage the shoulder with the interior surface of the upper part of the body members.

15. A condiment shaker for a selected condiment comprising a pair of mating body members having mating edges and defining an interior compartment for the selected condiment body members being so constructed and arranged to define an upper part and lower part, a rotatable top extending over the upper part, means for providing access to and from the compartment for the selected condiment through the top and body upper part of the members, and means for connecting the top and body members in an assembled condition the upper part of the body members having interior surfaces the connecting means including a securement pin, aligned holes defined by hole surfaces in the top and upper part of the body members receiving the pin, the pin having a head engaged with the top and a pair of spring arms extending from the head and having free ends, the free ends of the arms having a beveled surface that defines an intermediate shoulder that engages with the interior surfaces of the upper part of the body members, the spring arms being adapted to flex inwardly upon engagement of the beveled faces with the hole surfaces defining the aligned holes in the top and the upper part of the body members defining the aligned holes until the shoulder clears the aligned holes in the top and upper part of the body member and the arms spring outwardly to engage the shoulder with the interior surface of the upper part of the body member, the upper part of one member includes pour holes and the upper part of the other member includes a filling opening, an opening in the top adapted to be rotated and aligned with the filling opening to fill the compartment with the selected condiment and the pour holes to dispense the selected condiment, the pour holes are about the same size and configuration as one another, the opening in the top is adapted to be rotated to a sealed position intermediate the pour holes and opening in the body member to effectively seal the compartment, interengaging latching surfaces of the top and body members releasably align and latch the top opening with the pour holes and fill opening in the body members and the sealed position, the body members have a base and a flat bottom located at the base, the body members and top define a substantially spherical configuration, means are provided for preventing the body members from rotating relative to one another, a shelf spaced from the base to define a lower compartment, and a weight in the lower compartment to maintain the shaker in an upright condition, the shelf of the body members include a tongue and groove connection to seal this juncture, the mating edges of the body members include a peripherally extending tongue and groove connection to seal this juncture, the upper part of the body members are recessed and receive the top, the top and the lower part of the body members have an exterior surface each possessing substantially the same radius to define a substantially spherical shaker.

* * * * *